US005854643A

United States Patent [19]

Katsuyama

[11] Patent Number: 5,854,643

[45] Date of Patent: Dec. 29, 1998

[54] METHOD AND APPARATUS FOR ADJUSTING A GAP BETWEEN A PRINTING HEAD AND A PRINTING MEDIUM

[75] Inventor: Hitoshi Katsuyama, Tokyo, Japan

[73] Assignee: Canon Kabushiki Kaisha, Tokyo, Japan

[21] Appl. No.: 539,220

[22] Filed: Oct. 4, 1995

[30] Foreign Application Priority Data

| | | | |
|---|---|---|---|
| Oct. 7, 1994 | [JP] | Japan | 6-244421 |
| Sep. 27, 1995 | [JP] | Japan | 7-249967 |

[51] Int. Cl.[6] ..... B41J 25/308; B41J 13/02; B65H 5/02

[52] U.S. Cl. ..... 347/8; 400/635; 271/7

[58] Field of Search ..... 347/104, 8, 16, 347/219, 220; 346/134; 400/635; 271/7, 198

[56] References Cited

U.S. PATENT DOCUMENTS

| | | | |
|---|---|---|---|
| 4,207,579 | 6/1980 | Gamblin et al. | 347/104 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,620,807 | 11/1986 | Polit | 400/56 |
| 4,723,129 | 2/1988 | Endo et al. | 347/56 |
| 4,740,796 | 4/1988 | Endo et al. | 347/56 |
| 5,274,399 | 12/1993 | Uchida et al. | 347/104 X |
| 5,280,308 | 1/1994 | Takahashi et al. | 346/134 |
| 5,345,863 | 9/1994 | Kurata et al. | 347/8 X |

FOREIGN PATENT DOCUMENTS

| | | | |
|---|---|---|---|
| 0377339 | 7/1990 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 62-053492 | 3/1987 | Japan . | |
| 62-149469 | 7/1987 | Japan | 400/635 |
| 2013172 | 1/1990 | Japan . | |
| 3046589 | 7/1991 | Japan . | |
| 5-147207 | 6/1993 | Japan | 400/635 |
| 5212851 | 8/1993 | Japan . | |

*Primary Examiner*—David F. Yockey
*Attorney, Agent, or Firm*—Fitzpatrick, Cella, Harper & Scinto

[57] ABSTRACT

Two roller members support an endless conveying member tensioned around them, where the endless conveying member conveys a printing medium. A first displacing unit displaces a first portion of the endless conveying member in the direction different from the traveling direction of the endless conveying member and a second displacing unit displaces a second portion of the endless conveying member opposite to the first portion in accordance with the displacement of the endless conveying member made by the first displacing unit. The first displacing unit is arranged to displace the portion of the endless conveying member which faces the printing head.

10 Claims, 14 Drawing Sheets

METHOD AND APPARATUS FOR ADJUSTING A GAP BETWEEN A PRINTING HEAD AND A PRINTING MEDIUM

BACKGROUND OF THE INVENTION

1. Field of the Invention

The present invention relates to a printing apparatus. More particularly, the invention relates to a printing apparatus capable of adjusting the tension of an endless conveying member when changing the gap between a printing medium and a recording head in accordance with the thickness of the printing medium to be conveyed on the endless conveying member.

2. Related Background Art

For a recording apparatus, there has been known a recording performed by a recording head on a recording medium such as a recording sheet mounted on the outer surface of an endless belt tensioned around a driving roller and a driven roller and conveyed by the belt. In a recording apparatus that uses an endless belt of the kind as means for conveying a recording sheet, a structure is arranged so that a part of the endless belt is being pressed by a roller or the like to eliminate its slackness in order to adjust the tension to obtain a given strength, or that either one of the driving and driven rollers is caused to be further away from or closer to the other in order to adjust the tension of the endless belt to provide a given strength.

Meanwhile, various recording apparatuses are structured to make the gap between the printing head and a recording sheet adjustable in accordance with the thickness of a recording sheet to be used. In this case, the platen that holds a printing medium is displaced in the recording area in the direction that the platen is placed further away from or closer to the printing head or the printing head is displaced in the direction that the printing head is placed further away from or closer to the platen. Then, in general, it is more often structured that the printing head side is displaced in accordance with the thickness of a printing medium.

However, in a recording apparatus that uses the so-called full line head, which is capable of recording on an area corresponding to the entire width of a printing medium in the direction different from the conveying direction of the printing medium or a color recording apparatus provided with a plurality of such full line heads arranged in the conveying direction of a recording medium, the recording head is inevitably made greater, and heavier in its weight. In such apparatuses, if it is intended to displace the recording head side in accordance with the thickness of a recording medium, the mechanism required for displacing the recording head itself becomes larger accordingly. Consequently, the recording apparatuses become larger and heavier as a whole.

Therefore, it has been practiced to provide a recording apparatus that conveys a printing medium by use of an endless belt as the belt to convey the printing medium, which is structured to enable the platen side to be closer to or further away from the printing head in accordance with the thickness of a printing medium to be used (that is, structured to arrange the conveying belt passing the recording area to be closer to or further away from the printing head). In this way, it is intended to avoid making the recording apparatus larger as a whole. In a belt conveying mechanism of the kind, too, a mechanism is provided to adjust the tension of the endless belt to be used.

FIG. 1 is a view which schematically shows the details of the conventional belt conveying mechanism as described above.

A pair of platen rollers 140 are rotatively supported by a roller supporting member 141. The roller supporting member is arranged to be movable in the vertical direction (up and down). A conveying roller 120 is a driving roller driven by a driving mechanism (not shown). Meanwhile, a conveying roller 110 is a driven roller to rotate following the rotation of the driving roller 120 through a belt 130. The conveying roller 120 is fixed only to make its rotation possible.

On the other hand, the conveying roller 110 is arranged to move in the direction to be further away from or closer to the conveying roller 120, that is, it is made possible to shift and rotate only in the horizontal direction to the left and right in FIG. 1. Also, the conveying roller 110 is biased by means of a tension adjustment spring 131 in the direction that it is further away from the conveying roller 120. In this way, an appropriate tension is exerted on the conveying belt 130.

However, the belt conveying mechanism described above presents the following problems with respect to the gap adjustment required for an ink jet head serving as a printing head.

In accordance with the structure described above, the circumferential length of the belt 130 (the total length of the belt) tends to change (the tension often changes) by the movement of the platen rollers 140 if the platen rollers 140 are caused to shift up and down in order to adjust the gap between the ink jet head and a printing medium. Here, however, the displacement of the adjustment spring 131 is only means for absorbing this change. Therefore, if such displacement becomes too great, the biasing force of the spring 131 is caused to increase, thus rather increasing the tension of the conveying belt 130 eventually. As a result, the belt 130 is caused to crack often or break in some cases.

Also, in accordance with the structure represented in FIG. 1, the conveying roller 110 on the upstream side is arranged to move horizontally. Therefore, it is difficult to parallel this roller with the conveying roller 120 precisely. Also, there is a problem that it is difficult to continuously maintain the parallel condition once set as it is. In such a case, the tension given to the belt becomes uneven so that the printing medium may be allowed to meander or take some irregular posture.

Further, since the conveying roller 110 is movably arranged as described above, it is required to arrange a pressure roller that presses the printing medium to the conveying roller 110 to move following the movement of the conveying roller 110. Consequently, there is encountered a problem that the mechanism and others needed for the operation of these rollers also become more complicated.

SUMMARY OF THE INVENTION

The present invention is designed in consideration of the problems described above. It is an object of the invention to provide a printing apparatus capable of making the tension exerted on an endless conveying member substantially constant even when the conveying surface of the endless conveying member is displaced.

It is another object of the present invention to provide a printing apparatus capable of conveying a printing medium in good condition at all times by preventing the endless conveying member from making any defective movement that may follow the gap adjustment or the like to be effectuated between the printing head and the endless conveying member.

It is still another object of the present invention to provide a printing apparatus capable of making the tension exerted on an endless conveying member substantially constant even when changing the gap between the printing head and the conveying surface of the endless conveying member.

It is a further object of the present invention to provide a printing apparatus capable of making the tension exerted on an endless conveying member substantially constant by suppressing the amount of expansion or contraction of the endless conveying member in its conveying direction even when changing the gap between the printing head and the conveying surface of the endless conveying member.

It is still a further object of the present invention to provide a printing apparatus capable of making adjustment to cope with changes of thickness of a wide printing medium even when changing the gap between the printing head and the endless conveying member by suppressing the amount of expansion or contraction of the endless conveying member in the conveying direction to exert a substantially constant tension on the endless conveying member.

It is still another object of the present invention to provide a printing apparatus capable of preventing an endless conveying member from meandering or taking any irregular posture in order to convey a printing medium in good condition by suppressing the amount of expansion or contraction of the endless conveying member in the conveying direction of the endless conveying member to exert a substantially constant tension on the endless conveying member even when changing the gap between the printing head and the conveying surface of the endless conveying member.

It is still another object of the present invention to provide a printing apparatus capable of setting a desirable gap between the ink jet head and a printing medium for printing media of various thicknesses, while maintaining non-contacting state between them, even when changing the gap between the ink jet head and the conveying surface of the endless conveying member by suppressing the amount of expansion or contraction of the endless conveying member in its conveying direction to exert substantially constant tension on the endless conveying member.

It is still another object of the present invention to provide a printing apparatus using a printing head to print on a printing medium being conveyed by means of an endless conveying member, comprising two roller members supporting the endless conveying member tensioned around them; a first displacing unit to displace the portion of the endless conveying member that faces the printing head in the direction different from the traveling direction of the endless conveying member; and a second displacing unit to displace the endless conveying member on the side opposite to the endless conveying member, which is displaced by means of the first displacing unit, in accordance with the displacement of the endless conveying member made by the first displacing unit.

It is still another object of the present invention to provide a printing apparatus using a printing head to print on a printing medium, comprising a belt conveying mechanism to convey the printing medium by causing a belt to travel; a first pressure member to displace the belt in the direction different from the traveling direction of the belt; and a second pressure member elastically coupled to the pressing portion of the first pressure member to press the belt by the application of elasticity thus exerted.

It is still another object of the present invention to provide a mechanism for conveying a printing medium and a printing apparatus using such mechanism for conveying a printing medium, being capable of minimizing the variation of tension exerted on a belt as a whole by arranging to change the elasticity of a second pressure member, such as rollers to press the belt, in accordance with the displacement of the belt made by a first pressure member such as platen rollers to press the belt.

DETAILED DESCRIPTION OF THE PREFERRED EMBODIMENTS

Hereinafter, with reference to the accompanying drawings, the detailed description will be made of the embodiments in accordance with the present invention.

Figure 2:
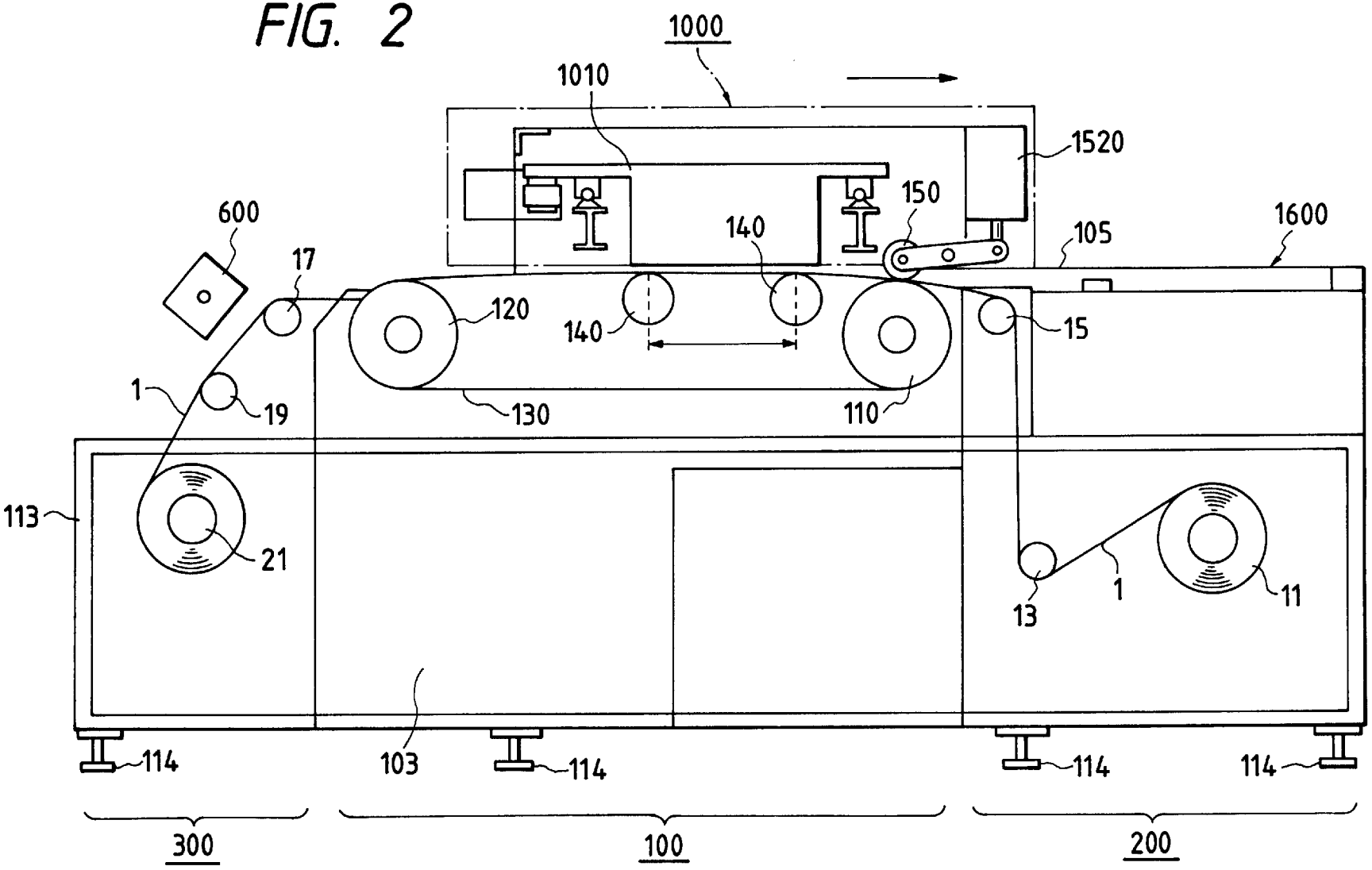
FIG. 2 is a cross-sectional view schematically showing a printing apparatus in accordance with the present invention.

FIG. 2 shows a printing apparatus in accordance with a first embodiment of the present invention.

Here, a reference numeral 1 designates cloth prepared as a printing medium. The cloth 1 is being fed out from the feeding roller 11 of a feeding unit 200 as the roller rotates, and wound up by a winding roller 21 through a conveying roller 17 and intermediate roller 19 after it is conveyed substantially in the horizontal direction by means of a conveying unit 100 arranged in the location facing a platen unit 1000 subsequent to being conveyed through intermediate rollers 13 and 15.

The conveying unit 100 is provided with conveying rollers 110 and 120 arranged on the upstream and downstream sides of a printing unit 1000 roughly in the conveying direction of the cloth 1; a conveying belt 130 prepared in an endless mode rotatively arranged between these rollers; and a plurality of platen rollers 140 to cause the conveying belt 130 to be developed and tensioned appropriately in a given range in order to regulate and improve the flatness of the printing surface of the cloth. Here, the conveying belt 130 used for the present embodiment is a metallic belt such as disclosed in Japanese Patent Laid-Open Application No. 5-212851, and as partially enlarged in FIG. 1 for representation, an adhesive layer (sheet) 133 is provided on the surface thereof. Then the cloth 1 is adhesively attached to the conveying belt 130 by means of the adhesive layer 133 and a fixing roller 150, thus securing its flatness at the time of printing.

Figure 1:
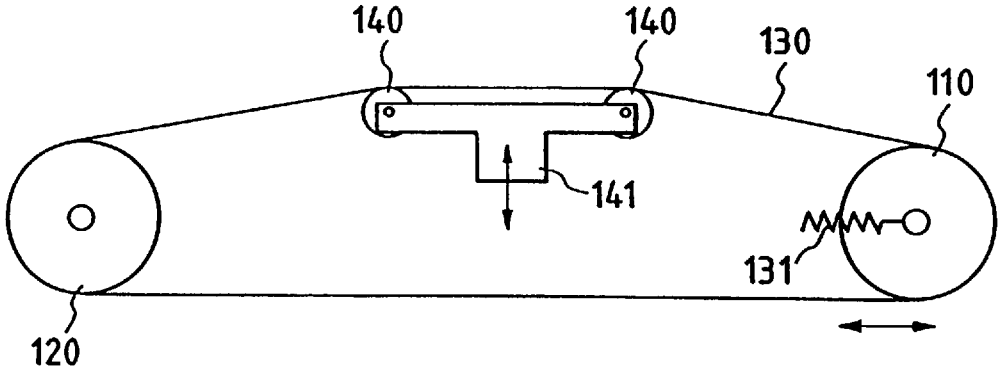
FIG. 1 PRIOR ART
FIG. 1 is a side view which schematically shows the structure of a conveying unit in accordance with one conventional example of a printing apparatus.

In this respect, a carriage 1010 is installed on the printing unit 1000 movably in the direction perpendicular to the surface of FIG. 1 and FIG. 2. During the traveling period of the carriage 1010, printing is performed by means of two ink jet heads installed on the carriage.

The cloth 1, being conveyed in a state where its flatness is thus secured, is provided with a printing agent by means of the printing unit 1000 while it is in the region between the platen rollers 140, and then, peeled off from the conveying belt 130 or the adhesive layer in the location where the conveying roller 120 is arranged. Hence it is being wound up by the winding roller 21, but on the way, a drying treatment is given by means of a drying heater 600. The drying heater 600 is effective particularly when a liquid is used as a printing agent. Here, as the drying heater 600, it may be possible to adopt a device in such a mode as to blow hot air onto the cloth 1 or radiate infrared rays, among other appropriate means. Also, in a position to which the printing unit 1000 can slide, a head shading station 1600 is arranged for the ink jet head 1010 in order to correct its density unevenness.

With the structure described above, the feed roller 11, the winding roller 21, the conveying rollers 110 and 120, and others are supported by a frame 113 and a side board 103 integrally arranged by a frame welding structure, which serve as the structural body of the textile printing apparatus. In a plurality of specific locations on the frame 113, level pads 114 are provided in order to adjust the leveling of the apparatus in the horizontal and height directions with respect to the surface of the installation floor.

Also, the printing unit 1000 is installed movably in the horizontal direction to enhance the operativity of maintenance work or the like such as replacement of belts.

Now, before describing some of the embodiments of the present invention, the conception with which to structure such embodiments will be described with reference to FIGS. 3A to 3C and FIGS. 4A to 4C.

Figures 3A, 3B, 3C:
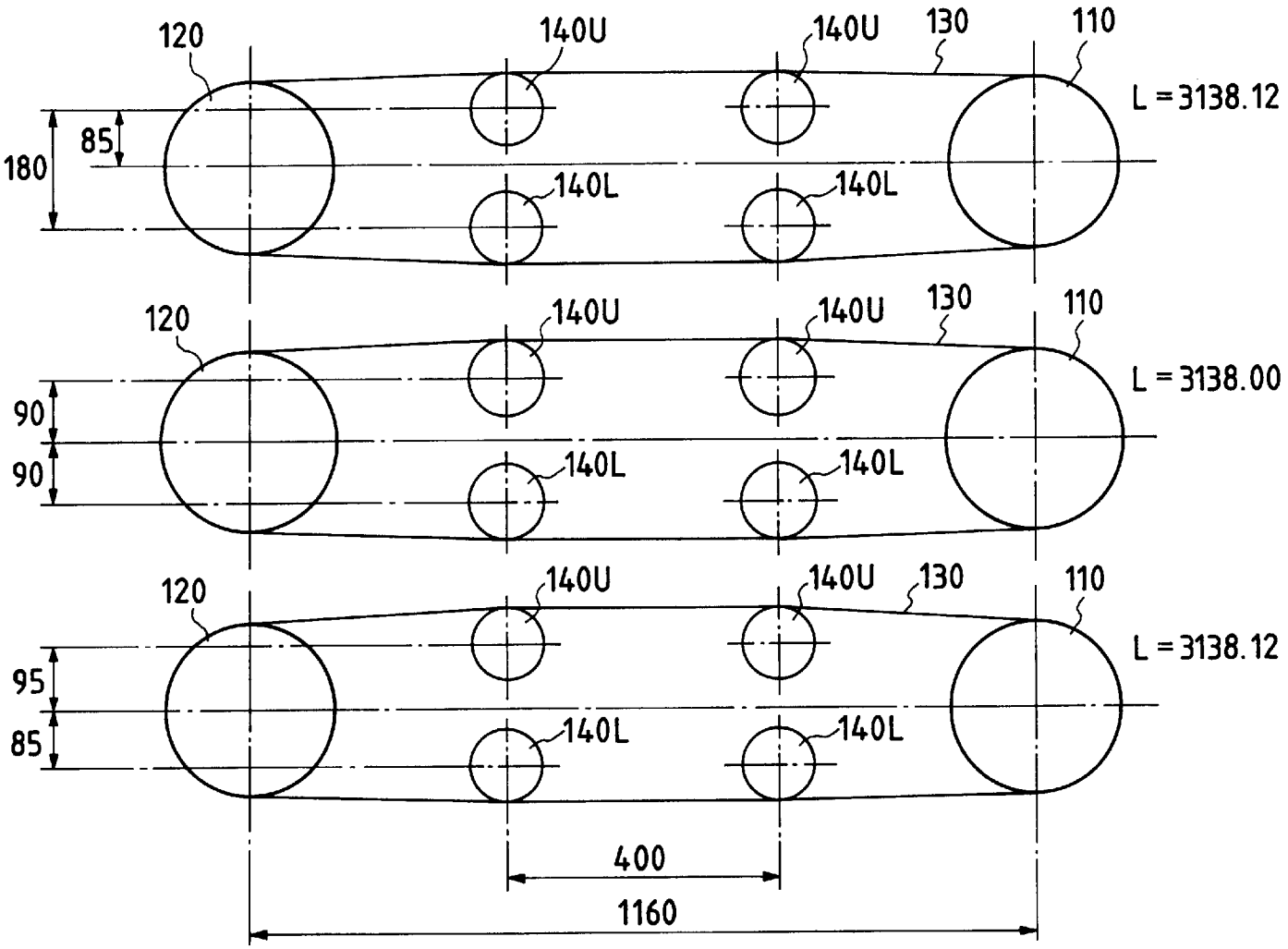
FIGS. 3A, 3B, and 3C are views schematically illustrating the principle of structure embodying the present invention.

FIGS. 3A to 3C are views which illustrate the structural concept of the present embodiments, in which an upper platen roller 140U and a lower platen roller 140L are arranged, and a driving roller 120 and a driven roller 110 are fixed to the printing apparatus main body so that the distance between them is constantly maintained (1,160 mm). Also, the upper and lower platen rollers 140U and 140L are vertically movable, while maintaining the distance between them to be 180 mm. FIG. 3B illustrates its standard state. FIG. 3A illustrates a state where the upper and lower platen rollers 140U and 140L are displaced downward by 5 mm. FIG. 3C illustrates a state where the upper and lower platen rollers 140U and 140L are displaced upward by 5 mm.

Figures 4A, 4B, 4C:
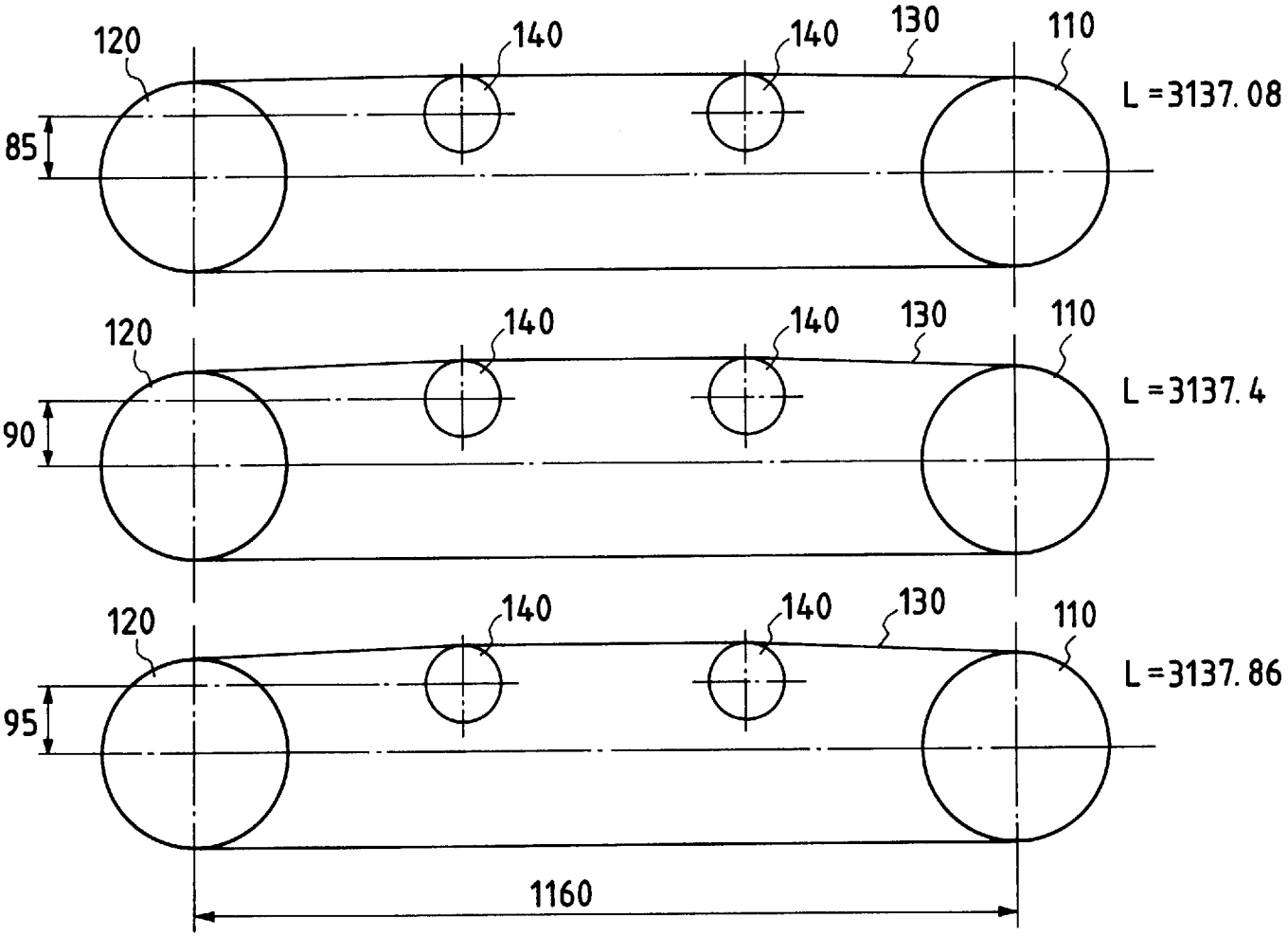
FIGS. 4A, 4B and 4C are views schematically showing the conventional structure as a comparative example in order to illustrate the principle of structure embodying the present invention.

On the other hand, FIGS. 4A to 4C illustrate the comparative example whose structure corresponds to the one in FIG. 1, in which no platen rollers are arranged on the lower side: only the upper platen rollers 140 are provided. Each of the other constituents is the same as the one shown in FIGS. 3A to 3C. Then, while the state illustrated in FIG. 4B is made standard, FIG. 4A shows a state where the platen rollers 140 are displaced downward by 5 mm, and FIG. 4C illustrates a state where the platen rollers 140 are displaced upward by 5 mm.

As is clear from FIGS. 3A to 3C and FIGS. 4A to 4C, whereas the circumferential length L of the belt changes only by 0.12 mm in either upper and lower displacements of the platen rollers 140U and 140L as in FIGS. 3A to 3C where the structural concept of the present embodiments is illustrated, it is clear that the circumferential length L changes −0.32 mm by the lower displacement of the conventionally structured platen rollers 140, and 0.46 mm by the upper displacement thereof as in FIGS. 4A to 4C where the comparative example is illustrated.

As described above, if the platen rollers are arranged up and down, changes in the circumferential length L of the belt resulting from the gap adjustment, that is, changes in the tensions of the belt, are made comparatively small. Therefore, it is possible to make the degrees of displacement smaller for the mechanism to absorb such changes of tension resulting from the tension adjustment. In other words, there is no need for any arrangement to make the conveying roller 110 movable on the driven side as in the conventional structure, and also, there is no need for any arrangement to cope with comparatively large changes in the tension by the provision of the tension adjustment spring that gives biasing force to such roller as represented in FIG. 2, for example.

(First Embodiment)

Figure 5:
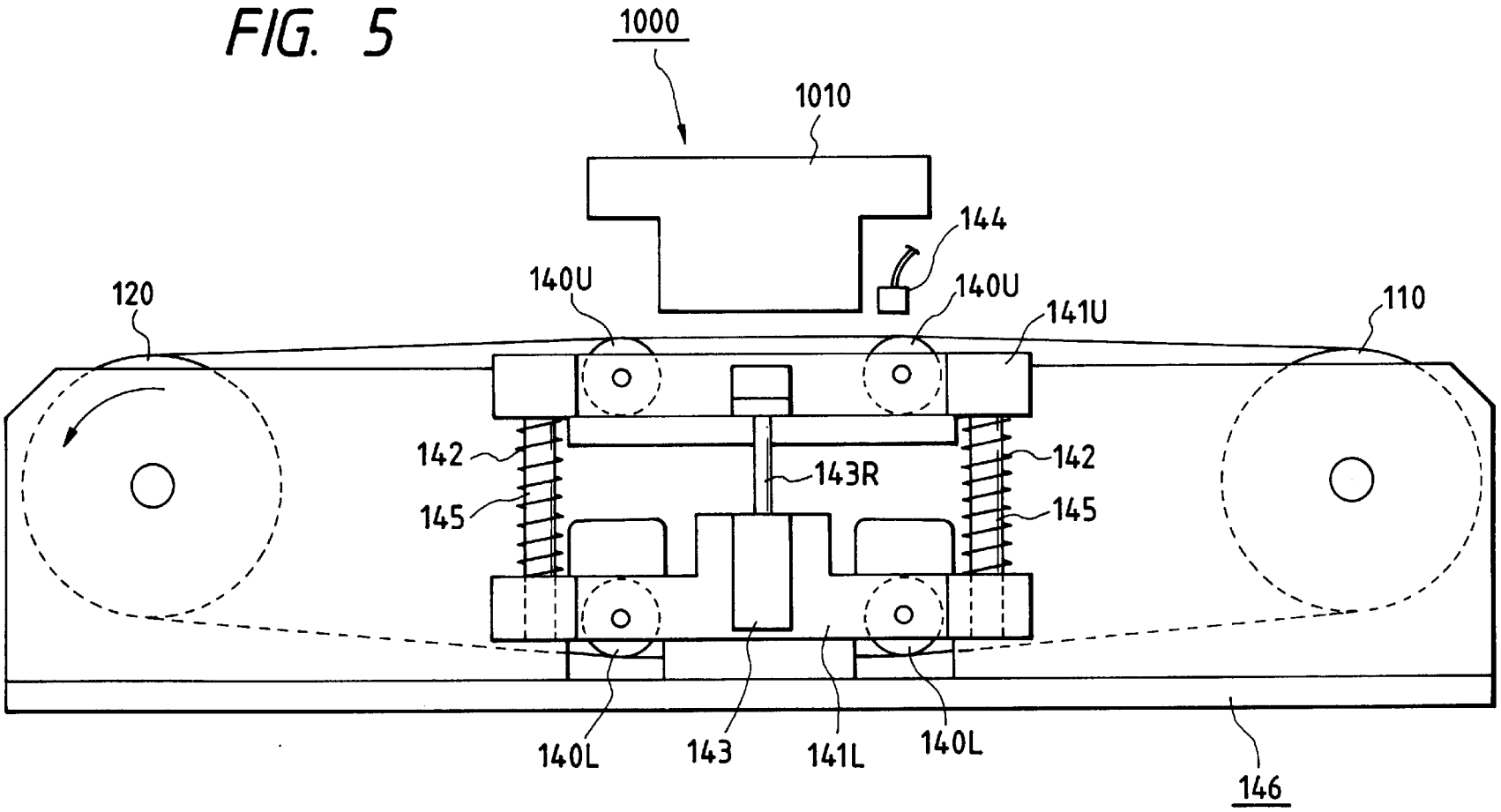
FIG. 5 is a side view which shows a conveying unit in accordance with a first embodiment of the present invention.
Figure 6:
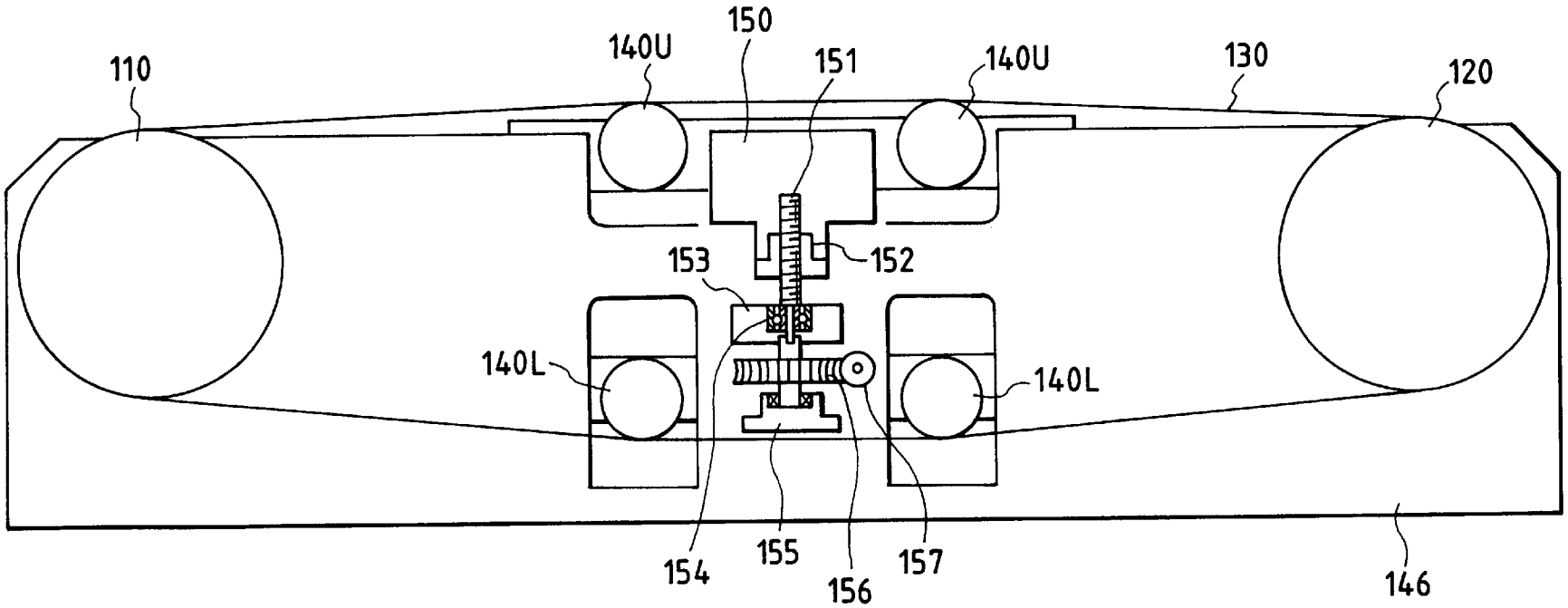
FIG. 6 is a cross-sectional view which shows the conveying unit represented in FIG. 5.
Figure 7:
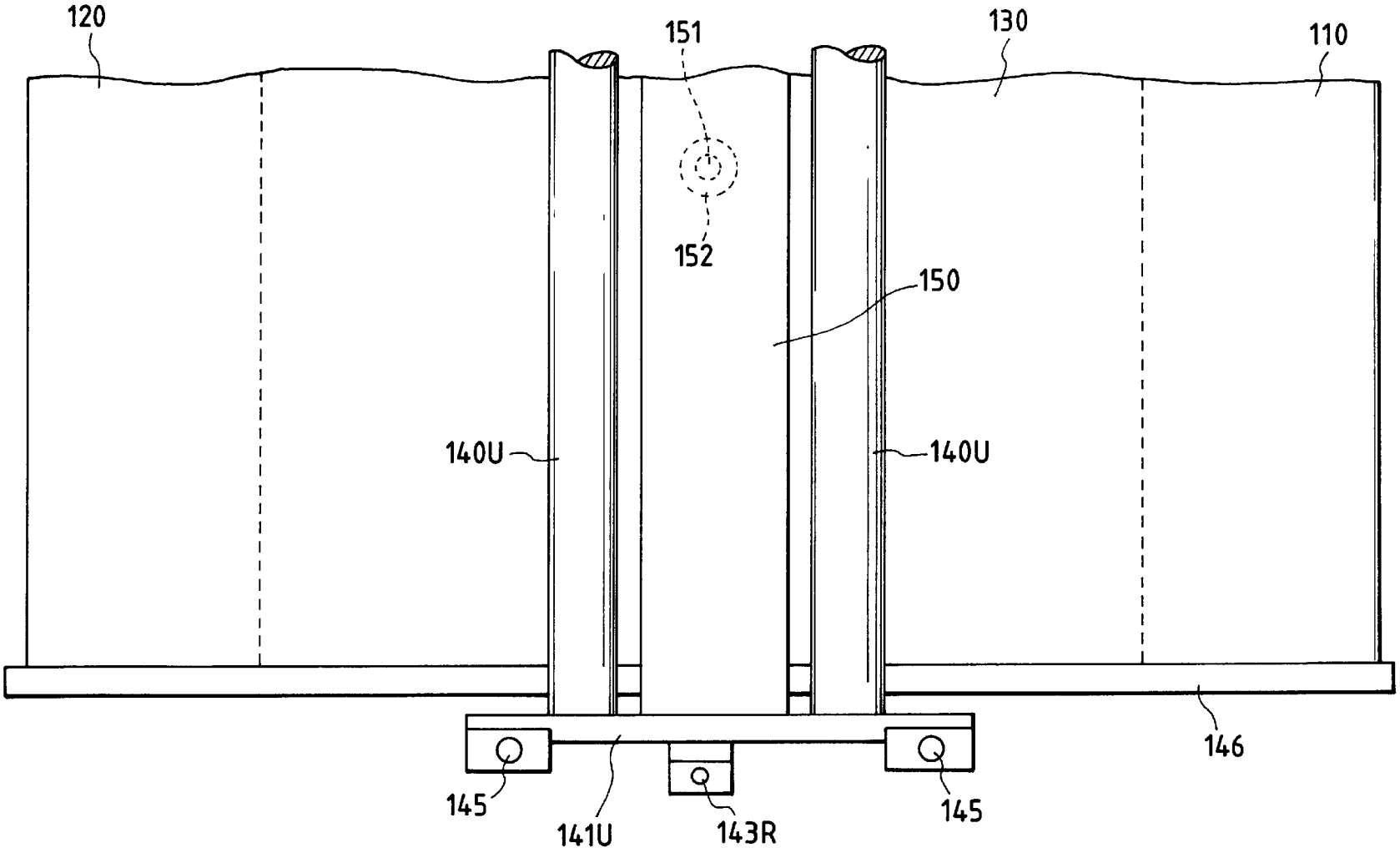
FIG. 7 is a top view which shows the conveying unit represented in FIG. 5.

FIG. 5, FIG. 6, and FIG. 7 are views showing the conveying unit in accordance with a first embodiment of the present invention. These are a side view, a view of this side observed from the back side, and a top view of the present embodiment, respectively.

The axes of conveying rollers 110 and 120 are rotatively fixed to a side board 146. Therefore, the distance between the rollers is made constant (1,160 mm) as described earlier. At the same time, both rollers are adjusted in advance to be in parallel to each other. Also, the platen rollers 140U and 140L are rotatively supported by the respective supporting boards 141U and 141L in such a manner that these rollers are in parallel to the conveying rollers 110 and 120, respectively.

On the outer side of both side boards 146 (only one of them is shown) of the conveying unit, a mechanism is arranged to cause the upper and lower platen rollers 140U and 140L to be interlocked and to maintain pitches as shown mainly in FIG. 5.

In other words, to a part of the upper supporting board 141U, the rod 143R of an air cylinder 143 is fixed, while the cylinder 143 main body is fixed to the lower supporting board 141L. In this way, the lower supporting board 141L is relatively biased downward. In this respect, the biasing force exerted by means of this cylinder 143 is not exercised usually. Only when the biasing force exerted by a spring 142 is not strong enough, the cylinder 143 is used in combination to provide a sufficient biasing. Also, to both ends of the upper supporting board 141U, one end of a linear guide shaft 145 is fixed, while the lower supporting board 141L is arranged to slidably engage with the linear guide shaft 145 through the holes formed on both ends thereof. Then the spring 142 is arranged in a mode that it winds around the shaft 145 between the upper supporting board 141U and the lower supporting board 141L. By means of this spring 142, the lower supporting board 141L is relatively biased downward.

With the structure described above, when the upper supporting board 141U is displaced upward or downward by means of a mechanism which will be described later, the lower supporting board 114L biased by means of the spring 142 is interlocked with the upper supporting board 141U to be displaced accordingly so that it is displaced upward or downward while keeping the distance constantly between them substantially.

Substantially in the central portion (see FIG. 7) of the conveying unit, a mechanism is arranged to displace the platen roller 140U upward or downward as shown mainly in FIG. 6.

A ball screw supporting board 153 is fixed to the side board 146. Meanwhile, a ball screw 151 engages with the ball screw supporting board 153 through an angular bearing 154. At the same time, the ball screw is fixed to a worm wheel 156. The angular bearing 154 regulates the backlashes of the ball screw 151 in the thrust and radial directions. The other end of the ball screw 151 engages with a ball screw nut 152 fixed to a fixing plate 150 of the upper supporting board, which connects the upper platen supporting boards 141U arranged respectively on both side portions.

With the structure described above, when a worm gear 157 is caused to rotate by means of a motor (not shown), the ball screw 151 coupled to the worm wheel 156 rotates. In accordance with the rotational direction thereof, the fixing plate 150 of the upper supporting board is caused to move so that the upper platen roller 140U shifts upward or downward.

Figure 8:
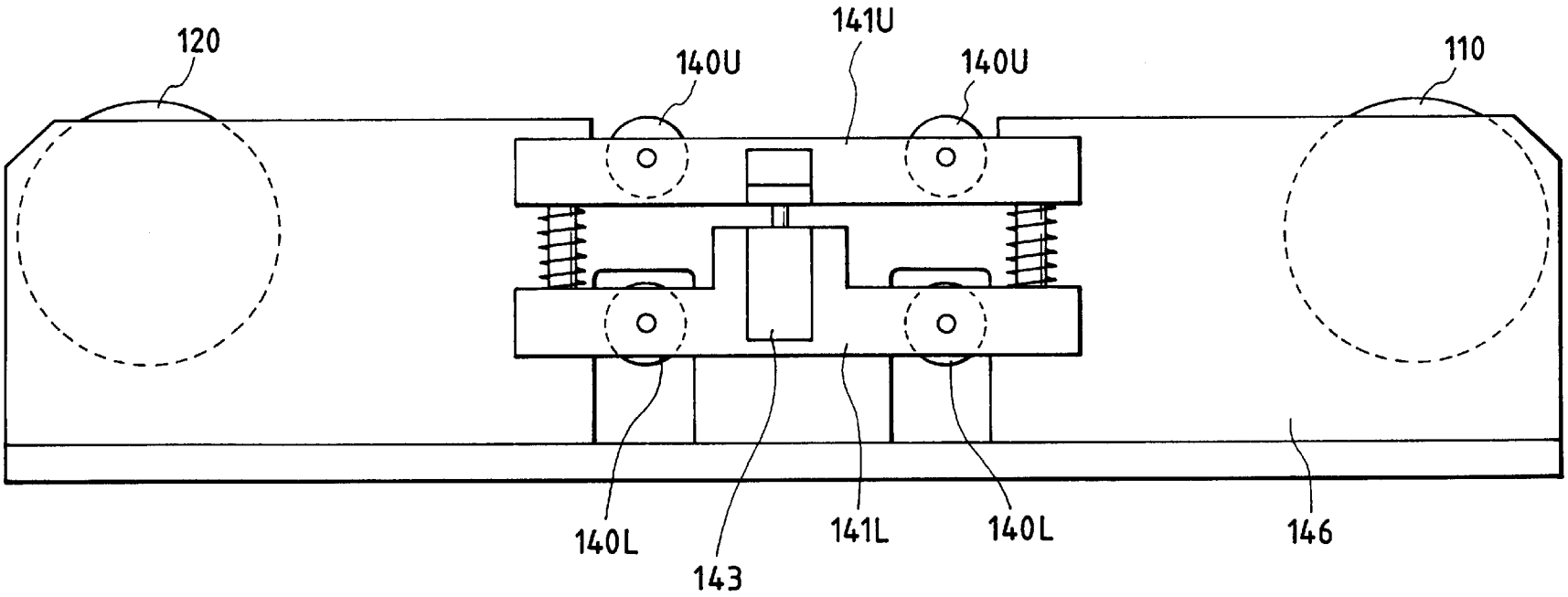
FIG. 8 is a side view which shows a state where the tension exerted on a conveying belt is released in the conveying unit represented in FIG. 5.

FIG. 8 is a view which shows a state that the tension of the conveying belt (not shown in FIG. 8) is released in the conveying unit of the first embodiment described above.

In other words, the supporting board 141L for the lower platen rollers is raised by means of the cylinder 143 in this released state. Also, it is possible to materialize lowering the supporting board 141U for the upper platen rollers by causing the worm wheel 156 to rotate.

(Second Embodiment)

Figure 9:
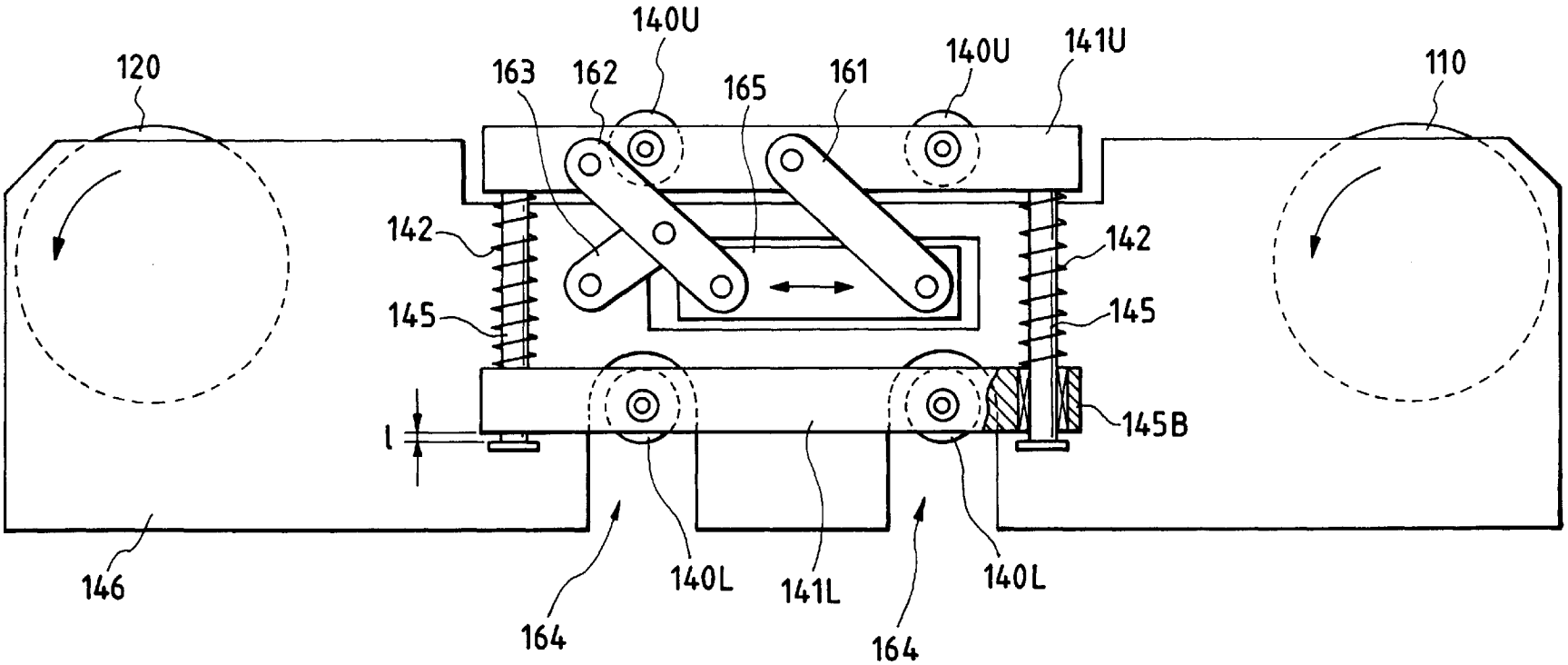
FIG. 9 is a side view which shows a conveying unit in accordance with a second embodiment of the present invention.
Figure 10:
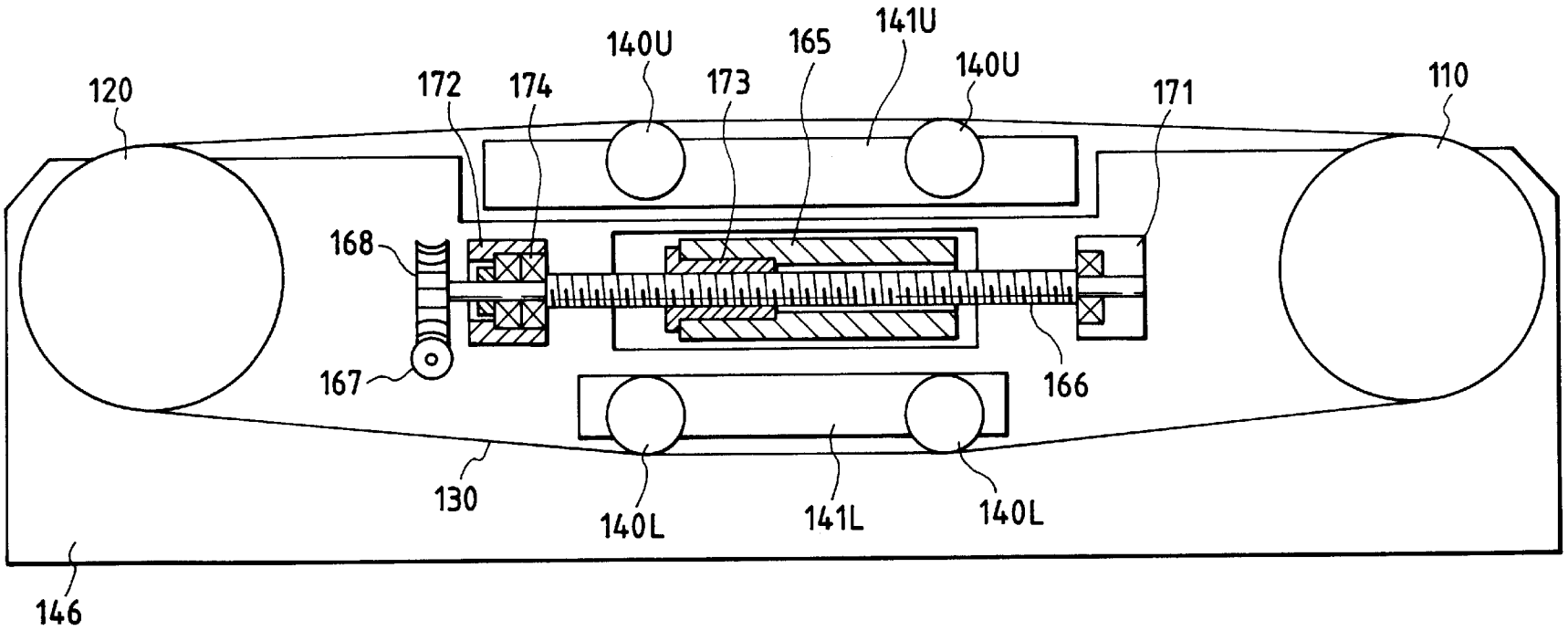
FIG. 10 is a cross-sectional view which shows the conveying unit represented in FIG. 9.
Figure 11:
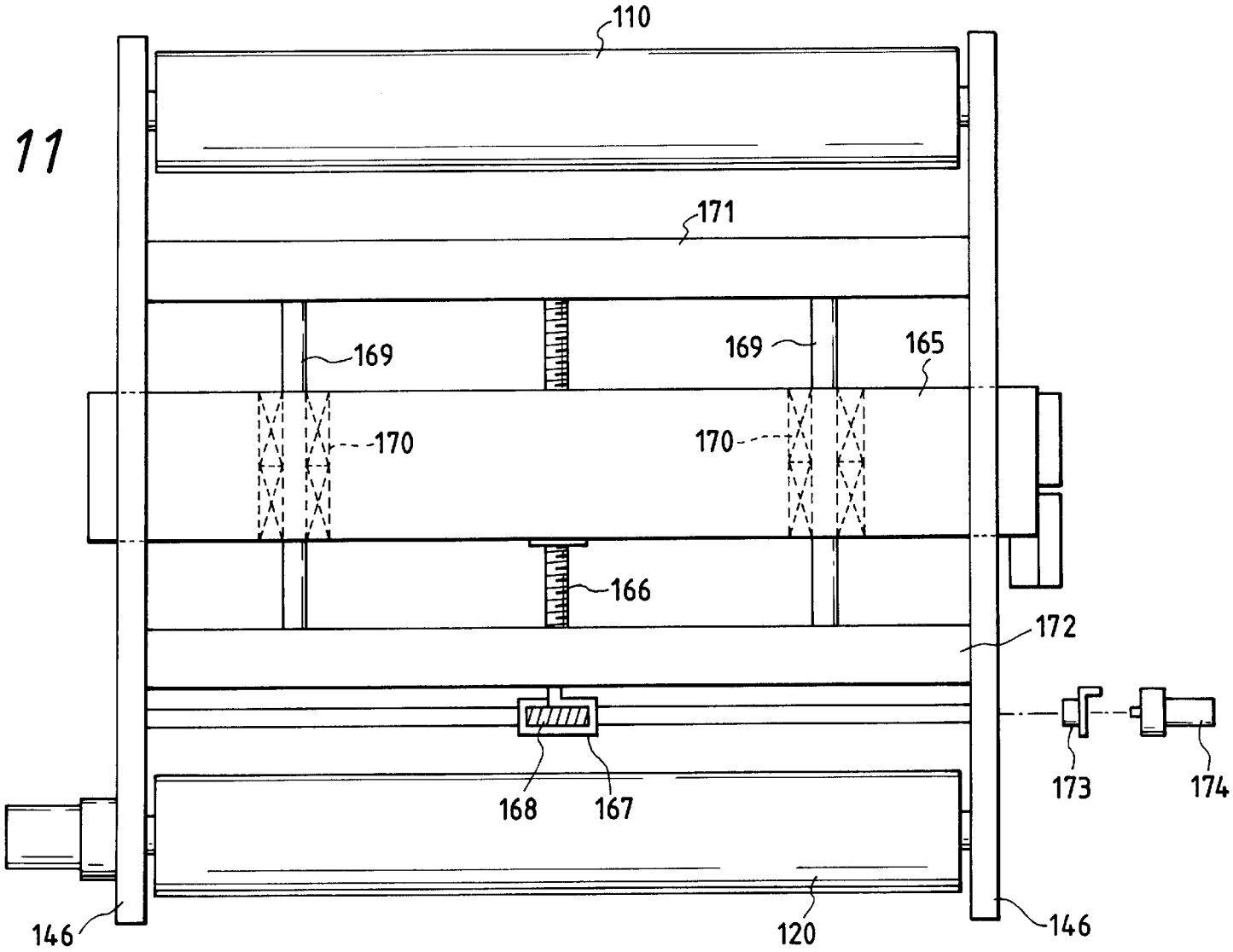
FIG. 11 is a top view which shows the conveying unit represented in FIG. 9.
Figure 12:
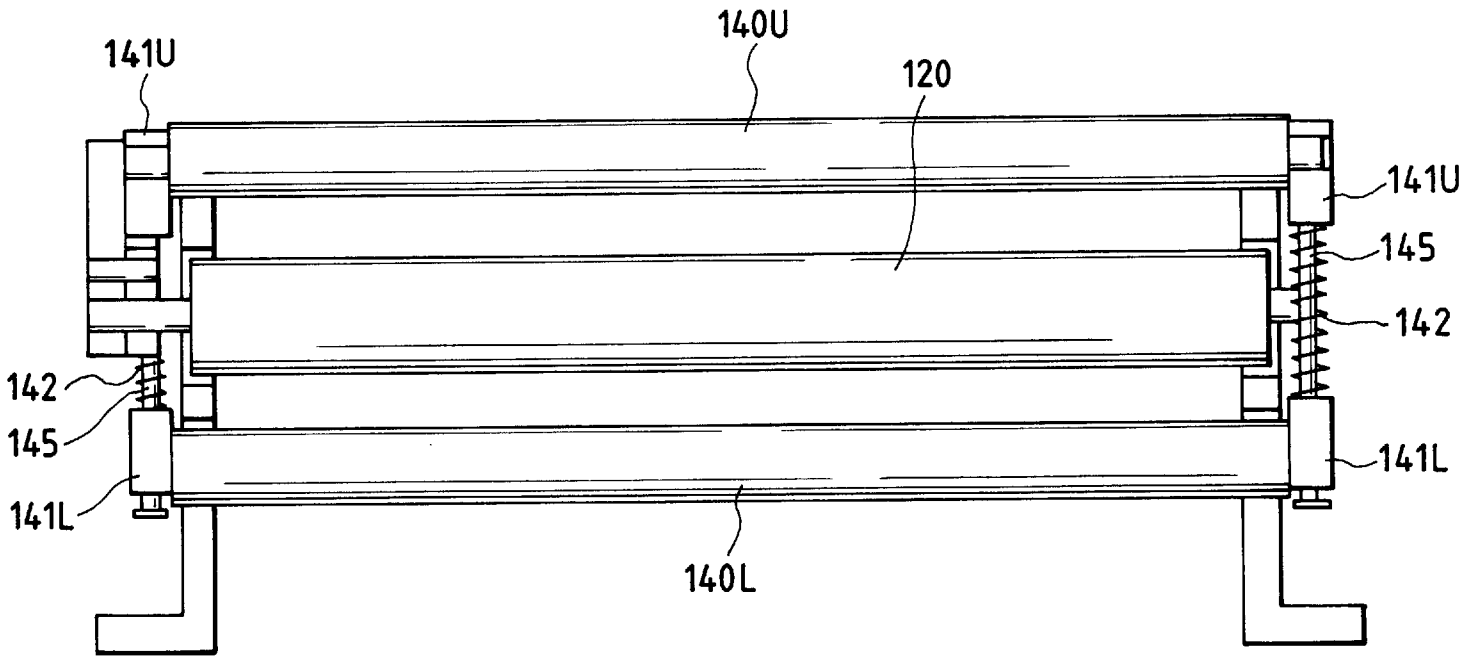
FIG. 12 is a front view which shows the conveying unit represented in FIG. 9.

FIG. 9 to FIG. 12 are views which illustrate the structure of a conveying unit in accordance with another embodiment of the present invention. FIG. 9 is a side view; FIG. 10 is a cross-sectional view; FIG. 11 is a top view; and FIG. 12 is a front view thereof observed from the conveying roller 120 side.

Figure 13B:
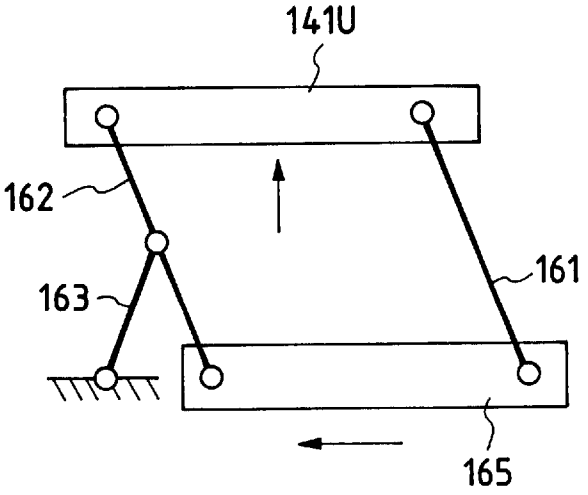
FIGS. 13A and 13B are views which schematically show the linkage for the conveying unit represented in FIG. 9.
Figure 13A:
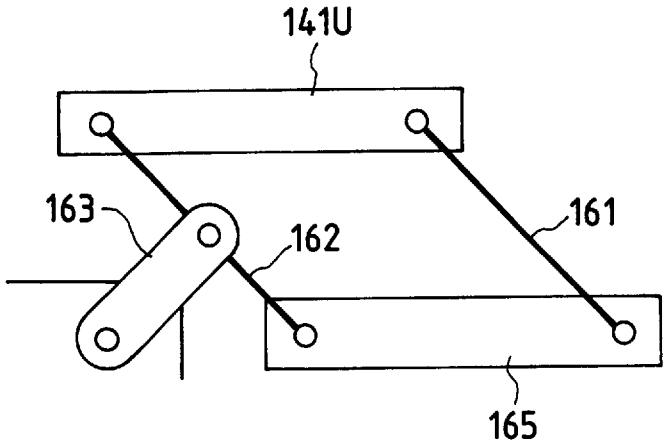

In accordance with the present embodiment, the mechanism required for raising and lowering the supporting board 141U for the upper platen rollers is structured by use of parallel links. As shown in FIG. 9, a fixed link 163 is fixed to a side board 146. To one end of the fixed link 163, the central portion of a movable link 162 is rotatively mounted. One end of this movable link 162 is rotatively mounted on the supporting board 141U for the upper platen rollers, while the other end is rotatively mounted on a slider 165. Likewise, one end of the movable link 161 is rotatively mounted on the supporting board 141U for the upper platen rollers, while the other end is rotatively mounted on the slider 165. FIGS. 13A and 13B show this linkage schematically.

The slider 165 is guided by means of a linear guide bearing 170 and linear guide shaft 169 as shown mainly in FIG. 10, thus being arranged to shift in the left and right directions in FIG. 10. Meanwhile, on this slider 165, a ball nut 173 that engages with a ball screw 166 is mounted so that the slider 165 is shiftable in the left and right directions when the ball screw 160 rotates. In other words, both ends of the ball screw 166 are respectively installed on the supporting boards 171 and 172 on the upstream and downstream sides, which are fixed to the side board 146. On one end of the ball screw, a worm wheel 168 is mounted to engage with a worm gear 167. The worm gear 167 rotates manually through a handle 173 or by use of a motor 174.

The shift of the slider 165 as described above is transformed into the vertical shift of the supporting board 141U for the upper platen rollers through the aforesaid linkage.

In this respect, the gap adjustment described above may be possible by controlling the rotation of the worm gear in accordance with the gap to be sensed by the gap sensor 144 shown in FIG. 5.

(Third Embodiment)

Figure 14:
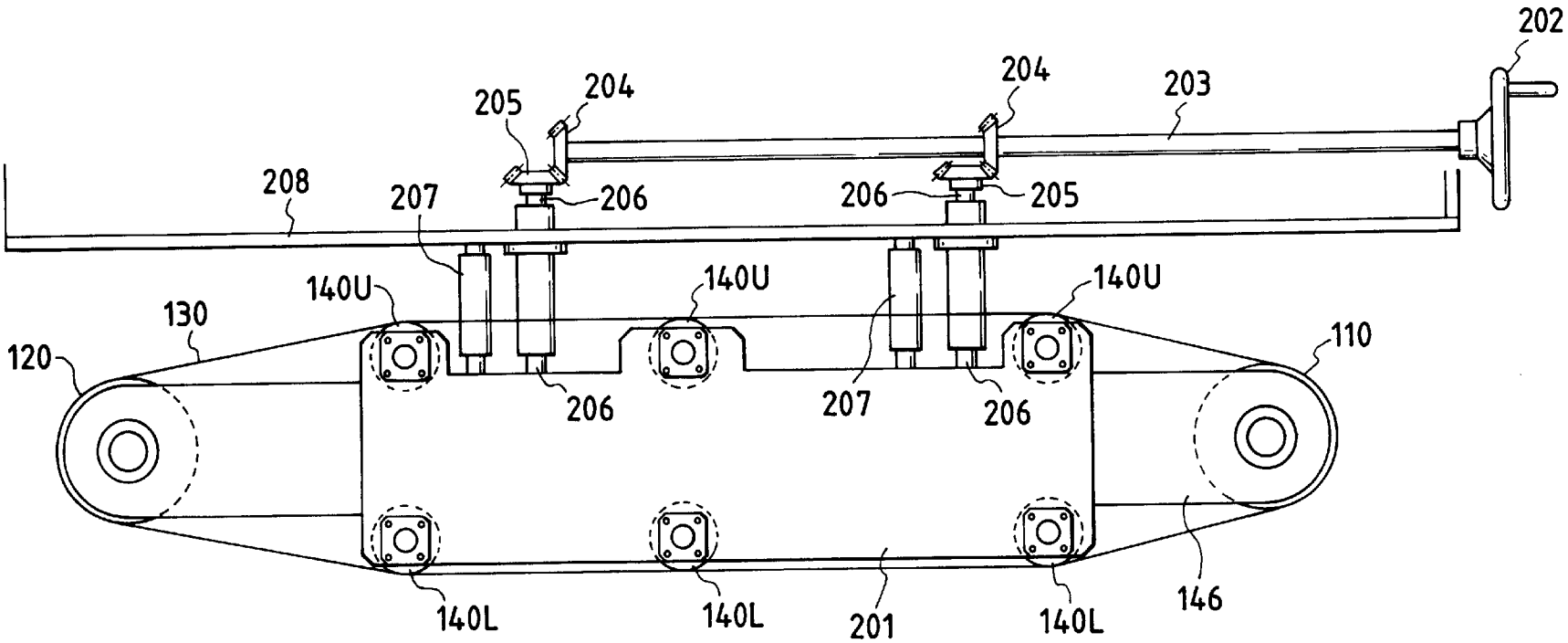
FIG. 14 is a side view which shows a conveying unit in accordance with a third embodiment of the present invention.

FIG. 14 is a side view which shows a conveying unit in accordance with a third embodiment of the present invention.

Conveying rollers 110 and 120 are rotatively mounted on the side board 146 in such a manner that the axes thereof are made parallel to each other. At the same time, it is structured so that the roller 110 on the driven side is caused to move further away from or closer to the roller 120 on the driving side, while maintaining the parallel condition between them, in order to conduct the initial setting of the belt 130 or the like.

Each of three platen rollers 140U and 140L is rotatively mounted on a pair of supporting boards 201, which face each other, so that each of the rollers is in parallel to the conveying rollers 110 and 120. Particularly, the three platen rollers 140U mounted on the supporting board 201 are arranged in such a manner that the conveying surface of the belt 130, being guided by these platen rollers 140U, is made extremely flat so as to preferably serve as the printing area for a printing medium.

The pair of the supporting boards 201 are arranged to move vertically when an operator rotates a handle 202 to cause threaded shafts 206 to rotate, thus allowing each tooth portion provided for the respective shaft to engage with each tooth unit (not shown) mounted on the supporting board 201 through the rotational shaft 203, gears 204 and 205. In this respect, shafts 207 are the members to support the side board 146 to a part 208 of the housing of the printing apparatus.

With the structure described above, when the operator rotates the handle 202, the platen rollers 140U and 140L are caused to shift vertically while maintaining its positional relationship as it is. In this way, it is possible to move the conveying surface of the belt 130, which is guided by the three platen rollers 140U to serve as the printing area for a printing medium, further away from or closer to the ink jet head mounted on the carriage 1010 that faces such conveying surface of the belt. Therefore, it is possible to change the gap between the surface of the belt and the ink jet head while minimizing the changes in the circumferential length of the belt that may occur following the vertical movement of the platen rollers 140U and 140L.

In this respect, the description has been made of a structure where the handle 202 is rotated by the operator, but it is possible to obtain the same effect by the vertical movement of the supporting board 201 with the rotation of the threaded shafts 206 by the application of driving force generated by a motor or the like.

Further, it is possible to automatically print on various printing media by arranging a structure to control the vertical movement of the supporting board 201 with the rotation of the threaded shafts 206 by the application of driving force of a motor or the like in accordance with the thickness of a printing medium to be used, which is detected in advance and guided to the printing area.

In accordance with each of the embodiments described above, a printing apparatus for printing by use of a printing head on a printing medium to be conveyed by means of an endless conveying member 130 is provided with two rollers 110 and 120 that support the endless conveying member tensioned around them; a first displacement unit 104U to displace the portion of the endless conveying member that faces the printing head in the direction different from the traveling direction of the endless conveying member; and a second displacement unit 104L to displace the endless conveying member on the side opposite to the endless conveying member displaced by means of the first displacement member in accordance with the displacement of the endless conveying member caused by the first displacement member. Therefore, it is possible to make the tension exerted on the endless conveying member substantially constant even when the conveying surface of the endless conveying member is displaced.

Further, it is possible to make the tension exerted on the endless conveying member substantially constant even when changing the gap between the printing head and the conveying surface of the endless conveying member.

Further, it is possible to make the tension exerted on the endless conveying member substantially constant by suppressing the amount of expansion or contraction of the endless conveying member in the conveying direction even when changing the gap between the printing head and the conveying surface of the endless conveying member.

Further, it is possible to cope with the changes in thicknesses of wide printing media by suppressing the amount of expansion or contraction of the endless conveying member in the conveying direction so as to exert a substantially constant tension on the endless conveying member even when changing the gap between the printing head and the conveying surface of the endless conveying member.

Further, it is possible to prevent the endless conveying member from meandering or taking defective posture in order to convey a printing medium in good condition by suppressing the amount of expansion or contraction of the endless conveying member in the conveying direction so as to exert a substantially constant tension on the endless conveying member even when changing the gap between the printing head and the conveying surface of the endless conveying member.

Further, it is possible to set the gap between the ink jet head and a printing medium preferably for printing media of various thicknesses, while maintaining non-contacting state between them, by suppressing the amount of expansion or contraction of the endless conveying member in the conveying direction so as to exert a substantially constant tension on the endless conveying member even when changing the gap between the printing head and the conveying surface of the endless conveying member.

Particularly, even for a large printing head that weighs heavily and needs a complicated mechanism to cause the head to move further away from or closer to the endless conveying side (platen side), it is possible to obtain the aforesaid effect of the conveying mechanism to adjust the gap between the printing head and a printing medium (head gap) by the application of displacement made on the endless conveying side (platen side). Here, it is also necessary for the endless conveying member to maintain the surface of a specific area in the printing region (because such maintenance is particularly important in the present embodiments where printing should be performed with the head and the printing medium being in non-contacting state). Therefore, the material used for the conveying member should not be too soft and easily deformed. A metallic belt or a rubber belt that is not easy to be deformed elastically should be employed. Therefore, in accordance with each of the embodiments described above, it is arranged so that the amount of expansion or contraction of the belt material is small when the head gap is adjusted, thus making it easier to select a belt material that is preferably used for the maintenance of the surface that provides a specific area in the printing region.

In this way, it is possible to obtain a printing apparatus capable of performing the full color printing in a higher precision on a wider printing area using various kinds of printing media, such as paper, cloth, or plate having a thickness of several cm, by use of a full line ink jet printing head that is practically used as a printing head at present, which discharges ink each in black, yellow, cyan, and magenta in more than 360 dpi.

(Entire process of ink jet textile printing by use of an apparatus in accordance with the embodiments described above)

Now, the description will be made of the entire process of ink jet textile printing performed by use of the apparatus in accordance with the embodiments described above.

After having completed the ink jet textile printing by use of the ink jet recording apparatus described above, the printed cloth is dried (including natural drying). Subsequently, the dyes on fiber texture are diffused, and then, a step is taken to cause the dyes to react and fix them on the cloth. In this step, it is possible to obtain both a sufficient coloring and durability by the fixation of dyes.

For the diffusion and reactive fixation, conventionally known steps are adoptable. For example, the steaming method will do. Here, in this case, it may be possible to give alkali treatment to the cloth in advance before the printing process is executed.

After that, in the postprocesses, non-reactive dyes and substances used for the preprocesses are removed. Lastly, then, the recording is completed through the adjustment finish, such as defect correction, ironing finish, and other related steps.

Now, particularly for the cloth used for the ink jet printing, the following properties are required:

(1) The color of ink should come out in a sufficient density.

(2) The degree of exhaustion of ink should be high.

(3) Ink should dry quickly on the cloth.

(4) Ink should not blur irregularly on the cloth.

(5) The cloth should be easy to be conveyed in the apparatus.

In order to satisfy these properties, it is possible for the present invention to preprocess the cloth as required. For example, in accordance with Japanese Patent Laid-Open Application No. 62-53492, there is disclosed a cloth provided with a layer for receiving ink. Also, in Japanese Patent Publication No. 3-46589, it is proposed to provide the cloth in which reduction preventive agent or alkaline substance is contained. As an example of such preprocess, it is possible to cite a treatment, which is made to enable these cloths to contain a substance selected from among alkaline substance, water soluble polymer, synthetic polymer, water soluble metallic salt, urea, and thiourea.

For the alkaline substance, it is possible to cite, for example, sodium hydroxide, potassium hydroxide, or other sodium alkaline metals, mono-, di-, tri-ethanol amine or other amine group, sodium carbonate, sodium bicarbonate, or other carbonates, alkaline metallic bicarbonate salt or the like. Further, there can be cited organic metallic salt such as calcium acetate, barium acetate, or ammonia and ammonia compound or the like. Also, it is possible to use the trichloro natrium acetate or the like that is transformed into alkaline substance by the application of steaming and drying heat. Particularly, preference is given to natrium carbonate and natrium bicarbonate as an alkaline substance, which is usable as a dye color of reactive pigment.

As water soluble polymer, there can be cited, for example, starch such as corn, wheat, cellulose substance such as carboxymethyl cellulose, methyl cellulose, hydroxyethyl cellulose, polysaccharide such as natrium alginic acid, arabian rubber, loquasweet bean rubber, tragacanth rubber, guam rubber, and tamarind seed, protein substance such as gelatin, casein, and water soluble natural polymer such as tannic substance and lignin substance.

Also, as synthetic polymer, there can be cited, for example, polyvinyl alcoholic compound, polyethylene oxide compound, alkali acid water soluble polymer, maleic anhydride water soluble polymer or the like. Of these substances, it is preferable to use poly-saccharide polymer or cellulose polymer.

As water soluble metallic salt, there can be cited, for example, alkali metals or a compound of pH4 to 10, which forms typical ionic crystals, such as halogenous compound of alkaline earth metals. As typical examples of such compounds, there can be cited NaCl, $Na_2SO_4$, KCl and $CH_3COONa$, or the like. Also, as alkaline earth metals, $CaCl_2$ and $MgCl_2$ or the like. Of these substances, salt group such as Na, K and Ca are preferable.

In the preprocesses, the methods for enabling cloth to contain those substances and others are not particularly limited. It may be possible to adopt a usually performed dipping method, a padding method, a coating method, or a spraying method, among others.

Further, the textile printing ink, which is applicable to cloth for use of ink jet printing, is such as just adhering to the cloths when it is applied to printing on the cloths. Therefore, it is preferable to execute a fixing process so that the color pigments in ink such as dyes should be fixed to the cloths. For a fixing process of the kind, any one of known methods is usable. For example, a steaming method, an HT steaming method, or a thermofixing method may be cited. If no alkali treatment is given to them in advance, there can be cited an alkali pad steaming method, an alkali blotch steaming method, an alkali shock method, an alkali cold fixing method, among others. Also, for the fixing process, there are those which include a reaction process or do not include it depending on the dyes to be used. Among those which do not include this process, there are some examples in which the dyes are contained in the cloths and do not allow them to be removed physically. Also, as ink, it is possible to use any one of them appropriately if only a required pigment is contained. Also, it may be possible to use the ink containing colors, not necessarily dyes. Further, in order to remove the non-reactive dyes and the substances used in the preprocess, rinsing may be applied in accordance with the conventionally known method after having executed the reactive fixation as described above. In this respect, it is preferable to perform the conventional fixing process together when exercising the rinsing treatment.

The printed articles that have been given the post processes as described above are cut in a desired size. Each of the pieces thus cut is processed in order to make it a final product, such as by means of sewing, bonding, welding, or the like, thus obtaining one-piece, dress, necktie, swim suit or other clothing, or bed cover, sofa cover, handkerchief, curtain, or the like. The method for processing cloths to make them clothing or other daily necessities by means of sewing and others is disclosed in many books publicly known, such as "Modern Knitting and Machining Manual (Published by Seni Journal Inc.)" and "Monthly Magazine, Souen (Published by Bunka Shuppan Kyoku)", among others.

In this respect, as a printing medium, there can be cited cloths, wall cloths, embroidery threads, wall papers, paper sheets, OHP films, anodized aluminum plates or various others to which a given liquid is applicable by use of the ink jet technologies. Here, the cloths include all the textiles, nonwoven textiles, and other cloths irrespective of materials, weaving and knitting methods.

For the present invention, it is possible to employ not only the aforesaid ink jet printing method, but also various printing methods. With the adoption of an ink jet printing method to embody the present invention, significant effects are obtainable. Of the ink jet printing methods, it is possible to demonstrate particularly excellent effects by the application of a method having means for generating thermal energy to be utilized as energy for discharging ink, which is capable of changing states of ink when the thermal energy is applied. In other words, the adoption of printing head and apparatus using the bubble jet method advocated by Canon Inc. contributes to obtaining still better results. With the application of a method of the kind, printing is possible in a higher density and precision.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system as well. Particularly, however, the method is suitable for the on-demand type because the principle is such that at least one driving signal, which provides a rapid temperature rise beyond a departure from nucleation boiling point in response to printing information, is applicable to an electrothermal transducer disposed on a liquid (ink) retaining sheet or liquid passage whereby to cause the electrothermal transducer to generate thermal energy to produce film boiling on the thermoactive portion of printing head, thus effectively leading to the resultant formation of a bubble in the liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent printing in a better condition.

In addition, the structure of the printing head may be as shown in each of the above-mentioned specifications wherein the structure is arranged to combine the discharging ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharge ports. In other words, irrespective of the modes of printing heads, it is possible to print reliably and efficiently in accordance with the present invention.

In addition, it is of course possible to structure the printing head in accordance with the mode of a printing apparatus. With respect to the mode of the so-called line printer, it should be good enough if only the printing head is structured so that its discharge ports are arranged over an area corresponding to the width of a printing medium. Also, for the printing head of a serial type as exemplified above, the present invention is effectively applicable to a printing head fixed to the apparats main body or to an exchangeable chip type, which can be electrically connected with the apparatus main body and ink is supplied from the apparatus main body to the head when it is installed in the apparatus main body, or to the printing head of a cartridge type in which an ink tank is formed together with the printing head itself.

Also, for the present invention, it is preferable to additionally provide a printing head with recovery means and preliminarily auxiliary means as constituents of the printing apparatus because these additional means will contribute to making the effectiveness of the present invention more stabilized. To cite them specifically, these are capping means for the printing head, cleaning means, compression or suction means, preliminary heating means using electrothermal transducing elements or heating elements other than these transducing elements or combination of both elements, and predischarge means for executing discharges other than those for printing.

Furthermore, in the embodiments of the present invention described above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general for an ink jet method, the ink may be such as to be liquefied when the applicable printing signals are given. In addition, it may be possible to adopt the use of ink having a nature of being liquefied only by the application of heat so as to positively prevent the temperature from rising due to the thermal energy by use of such energy as an energy to be consumed for changing states of ink from solid to liquid, or to prevent ink from being evaporated by use of the ink which will be solidified when left intact. In any case, it may be possible to apply to the present invention such ink having a nature to be liquified only by the application of thermal energy, such as the ink, which is capable of being discharged as ink liquid by enabling itself to be liquefied when the thermal energy is applied in accordance with printing signals, and the ink, which will have already begun solidifying itself by the time it reaches a printing medium. In this case, it may be possible to retain ink in the form of liquid or solid in the recesses or through holes of a porous sheet such as disclosed in Japanese Patent Laid-Open Application No. 54-56847 or 60-71260 in order to enable ink to face the electrothermal transducers. In the present invention, the most effective method adoptable for the various kinds of ink referred to above is the one which is capable of implementing film boiling as described above.

Moreover, as the mode of the present invention, it may be possible to adopt a copying apparatus combined with a reader or the like in addition to the image output terminal for a computer, or other information processing apparatus.

As is clear from the above description, the first pressure means such as the platen rollers presses the belt to displace it, and following this displacement, the elasticity of the second pressure member such as rollers to press the belt likewise changes in accordance with the present invention. Therefore, it is possible to make the changes in the tension exerted on the belt small as a whole.

What is claimed is:

1. A printing apparatus for printing with a printing head on a printing medium conveyed by an endless conveying member, comprising:

two roller members supporting the endless conveying member, the endless conveying member being tensioned around said two roller members;

a first displacing unit arranged between said two roller members and pressing the endless conveying member, the first displacing unit displacing a first portion of the endless conveying member facing the printing head in directions separating from and approaching toward the printing head;

a second displacing unit arranged between said two roller members and pressing the endless conveying member, the second displacing unit displacing a second portion of the endless conveying member opposite to the first portion of the endless conveying member displaced by said first displacing unit in the directions separating from and approaching toward the printing head; and means for moving said second displacing unit together with said first displacing unit and relative to said two roller members supporting the endless conveying member, while maintaining a distance between said first displacing unit and said second displacing unit substantially constant.

2. A printing apparatus according to claim 1, wherein said first displacing unit and said second displacing unit are connected elastically.

3. A printing apparatus according to claim 1, wherein said first displacing unit and said second displacing unit are connected by a link member.

4. A printing apparatus according to one of claims 1 to 3, wherein said first displacing unit displaces the endless conveying member to adjust a gap between the printing head and the printing medium conveyed by the endless conveying member.

5. A printing apparatus according to one of claims 1 to 3, wherein said first displacing unit and said second displacing unit each comprise a plurality of rollers.

6. A printing apparatus according to one of claims 1 to 3, wherein the printing medium comprises a cloth.

7. A printing apparatus according to one of claims 1 to 3, wherein the printing head is an ink jet printing head having ink discharge ports and discharges ink from said ink discharge ports.

8. A printing apparatus according to claim 7, wherein said ink jet printing head comprises electrothermal transducing elements that discharge ink from said ink discharge ports by thermal energy generated by said electrothermal transducing elements.

9. A printing apparatus according to one of claims 1 to 3, wherein said first displacing unit comprises a plurality of rollers provided along a conveyance direction of the recording medium and a support surface of the endless conveying member is provided opposed to the print head to support the recording medium between each of said plurality of rollers.

10. A method of adjusting a gap between a printing head and a printing medium conveyed by an endless conveying member, said method comprising the steps of:

supporting the endless conveying member around two roller members such that the endless conveying member is tensioned around the two roller members;

providing a first displacing unit arranged between the two roller members and pressing the endless conveying member, the first displacing unit for displacing a first portion of the endless conveying member facing the printing head in directions separating from and approaching toward the printing head;

providing a second displacing unit arranged between the two roller members and pressing the endless conveying member, the second displacing unit for displacing a second portion of the endless conveying member opposite to the first portion of the endless conveying member displaced by the first displacing unit in the directions separating from and approaching toward the printing head; and moving the second displacing unit together with the first displacing unit and relative to the two roller members supporting the endless conveying member, while maintaining a distance between the first displacing unit and the second displacing unit substantially constant.

* * * * *

UNITED STATES PATENT AND TRADEMARK OFFICE

CERTIFICATE OF CORRECTION

PATENT NO. : 5,854,643 Page 1 of 2

DATED : December 29, 1998

INVENTOR(S) : KATSUYAMA

It is certified that error appears in the above-indentified patent and that said Letters Patent is hereby corrected as shown below:

On title page, item

[56] References Cited:

FOREIGN PATENT DOCUMENTS,

"2013172" should read --2-013172--.

"3046589" should read --3-046589--.

"5212851" should read --5-212851--.

COLUMN 5:

Line 23, "being" should be deleted.

COLUMN 6:

Line 61, "that" should read --so that--.

COLUMN 7:

Line 5, "constantly" should read --substantially constant--.

Line 6, "them substantially" should read --them.--.

UNITED STATES PATENT AND TRADEMARK OFFICE

CERTIFICATE OF CORRECTION

PATENT NO. : 5,854,643 Page 2 of 2

DATED : December 29, 1998

INVENTOR(S) : KATSUYAMA

It is certified that error appears in the above-indentified patent and that said Letters Patent is hereby corrected as shown below:

COLUMN 10:

Line 54, "which" should read --which a--.

Line 63, "group," should read --groups,--.

COLUMN 13:

Line 15, "apparats" should read --apparatus--.

Signed and Sealed this

Tenth Day of August, 1999

*Attest:*

Q. TODD DICKINSON

*Attesting Officer*

*Acting Commissioner of Patents and Trademarks*